United States Patent [19]

Tanaka et al.

[11] 4,392,267

[45] Jul. 12, 1983

[54] APPARATUS FOR CONTINUOUSLY PICKLING THE OUTER SURFACES OF TUBULAR MATERIALS

[75] Inventors: Yoshiro Tanaka; Hayato Moroi; Yukihiko Komatsu; Kazuo Akagi; Ryujiro Shitamatsu, all of Shimonoseki; Tadashi Nishimura, Yokohama, all of Japan

[73] Assignee: Kabushiki Kaisha Kobe Seiko Sho, Kobe, Japan

[21] Appl. No.: 307,676

[22] Filed: Oct. 1, 1981

[30] Foreign Application Priority Data

Aug. 12, 1981 [JP] Japan ..... 56-120156[U]

[51] Int. Cl.[3] ..... B08B 9/02

[52] U.S. Cl. ..... 15/88; 72/40; 134/64 R; 134/122 R; 134/184

[58] Field of Search ..... 15/77, 88, 102, 97, 15/104.04; 134/1, 64 R, 122 R, 184; 72/39, 40; 29/81 H

[56] References Cited

U.S. PATENT DOCUMENTS 3,858,860 1/1975 Randall ..... 134/122

FOREIGN PATENT DOCUMENTS 3039303 5/1981 Fed. Rep. of Germany .... 134/64 R 604183 4/1960 Italy ..... 15/88

*Primary Examiner*—Edward L. Roberts

*Attorney, Agent, or Firm*—Oblon, Fisher, Spivak, McClelland & Maier

[57] ABSTRACT

An apparatus for continuously pickling the outer surfaces of hermetically plugged tubular members is described. The apparatus includes a plurality of liquid tanks which separately contain different pickling liquids and define through-holes in their respective front and rear walls on at least one common longitudinal line to permit the successive passage of the tubular members therethrough while rotating them around their respective longitudinal axes. The apparatus includes a cleaning tank and cleaning brush unit provided sequentially before the liquid tanks. The cleaning tank includes at least one ultrasonic cleaning oscillator and defines through-holes in the front and rear walls thereof for allowing said tubular members to pass through the cleaning tank and the brush unit. Since any oil, grease or dust can be completely removed by the cleaning tank and brush unit prior to pickling, it is possible to obtain tubular members having excellent outer surface quality.

6 Claims, 9 Drawing Figures

APPARATUS FOR CONTINUOUSLY PICKLING THE OUTER SURFACES OF TUBULAR MATERIALS

BACKGROUND OF THE INVENTION

1. Field of the Invention

This invention relates to a novel apparatus for continuously pickling the outer circumferential surfaces of tubular members, for example, zircaloy tubes adapted to clad nuclear fuel.

2. Description of the Prior Art

In order to obtain products of a metallic raw material of the same type as zircaloy, it is necessary, as well-known in the case of tubes made of, for example, zirconium or a zirconium alloy, to subject the inner and outer surfaces of the tubes to a pickling treatment using an acidic solution such as nitric acid or the like so as to obtain a mirror-finished surface after carrying out their final annealing step and then polishing only the outer surfaces of the tubes. Where such tubes are intended for use in cladding nuclear fuel, a particularly severe quality control is required and special care must be taken when pickling both inner and outer surfaces of the tubes.

With a view toward fulfilling such a severe requirement for high quality, the present assignee previously developed an apparatus for continuously pickling the outer surfaces of tubular materials as disclosed in Japanese Patent Publication No. 39629/1980. Although the superiority and industrial utility of the above-mentioned apparatus have been proven in the field of the present art, it has been found that the quality of the surface of a pickled tube is considerably affected by the degree of cleanliness of the surface of the tube prior to the pickling treatment and, where the surface before the pickling treatment is contaminated with oil, grease or dust, such a contaminant would become a serious cause for developing surface irregularities such as pits or the like.

SUMMARY OF THE INVENTION

With the foregoing in view, the present inventors have carried out extensive research to effectively remove any oil, grease or the like adhered on the surface of a tubular member prior to charging the tubular member into a tank containing a pickling liquid and which has resulted in completion of the present invention.

According to one aspect of this invention, there is provided an apparatus for continuously pickling the outer surfaces of hermetically plugged tubular members. The apparatus includes a plurality of liquid tanks which separately contain different pickling liquids and define through-holes in their front and rear walls on at least one common longitudinal line to permit the successive passage of the tubular members therethrough while rotating the tubular members around their respective longitudinal axes. The apparatus includes a cleaning tank containing a cleaning liquid and a cleaning brush unit sequentially provided before a first liquid tank. The cleaning tank includes at least one ultrasonic cleaning oscillator provided therein and defining through-holes in the front and rear walls thereof for allowing said tubular members to pass through the cleaning tank and cleaning brush unit.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
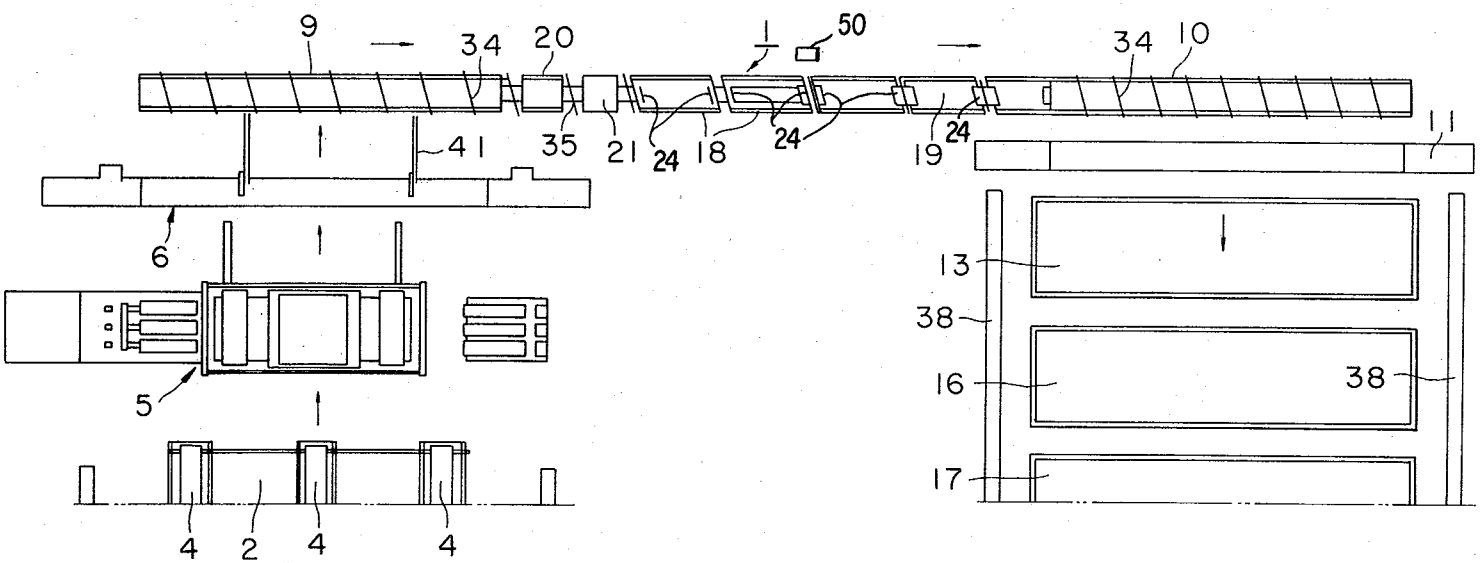
FIG. 1 is a schematic plan view of the one embodiment of the apparatus according to this invention.
Figure 2:
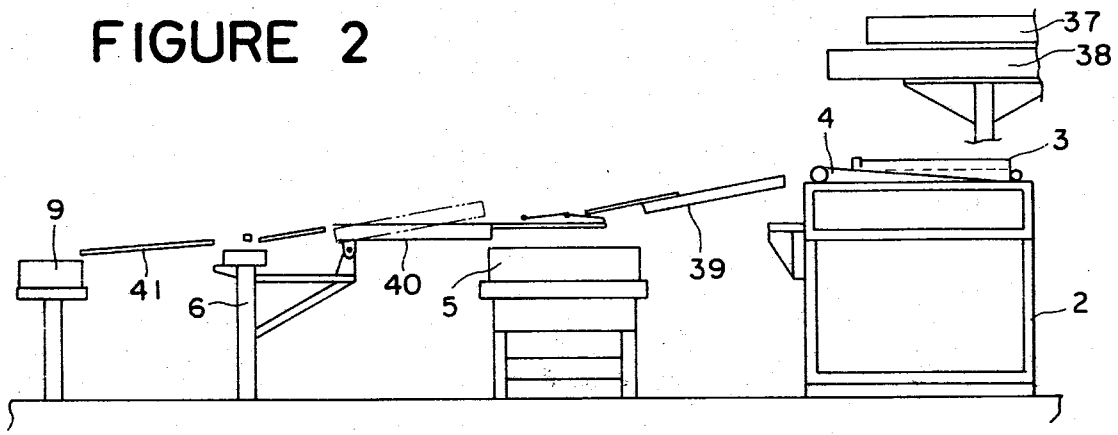
FIG. 2 is a side elevational view showing facilities for carrying out a pretreatment before feeding tubular members to the apparatus according to this invention.
Figure 3:
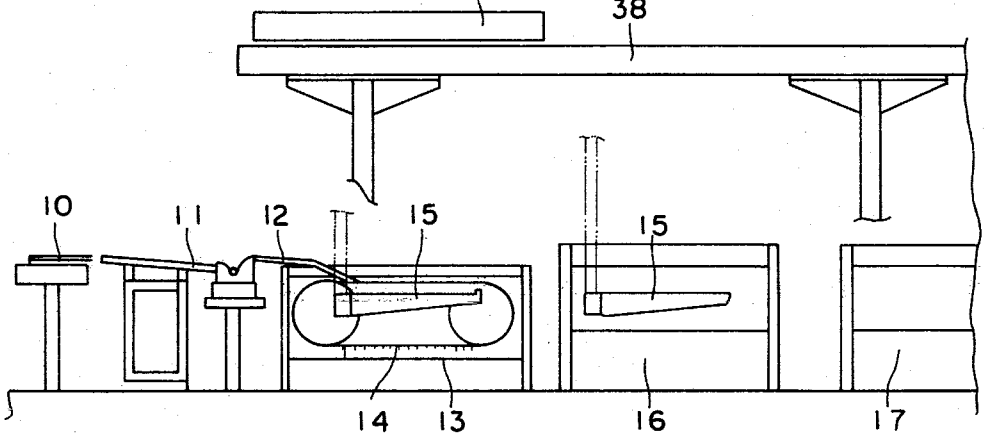
FIG. 3 is a side elevational view of facilities adapted to conduct a post-treatment of the tubular members therein after pickling the outer surfaces of the tubular members in the apparatus according to this invention.
Figure 4:
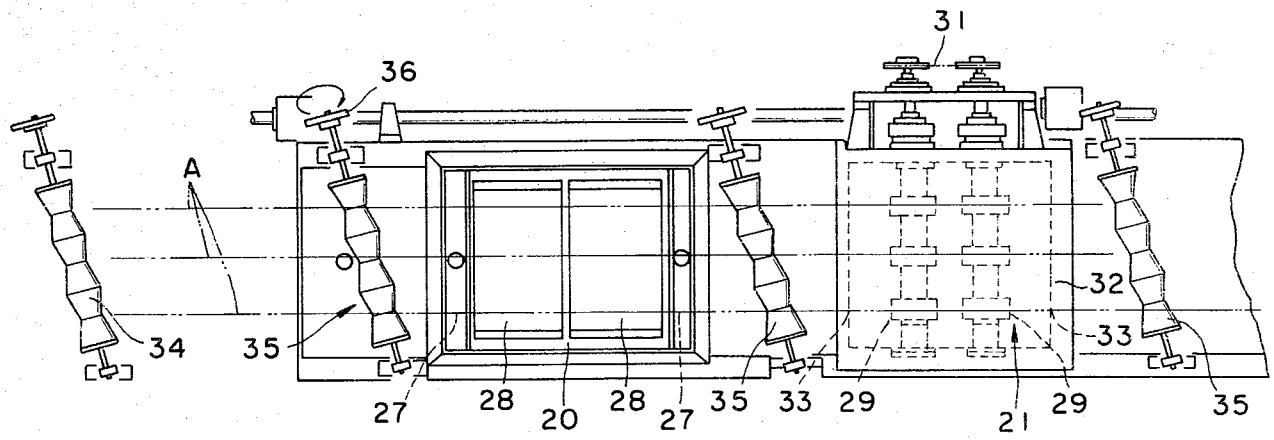
FIG. 4 is a plan view showing a cleaning tank filled with a cleaning liquid and a cleaning brush unit.
Figure 5:
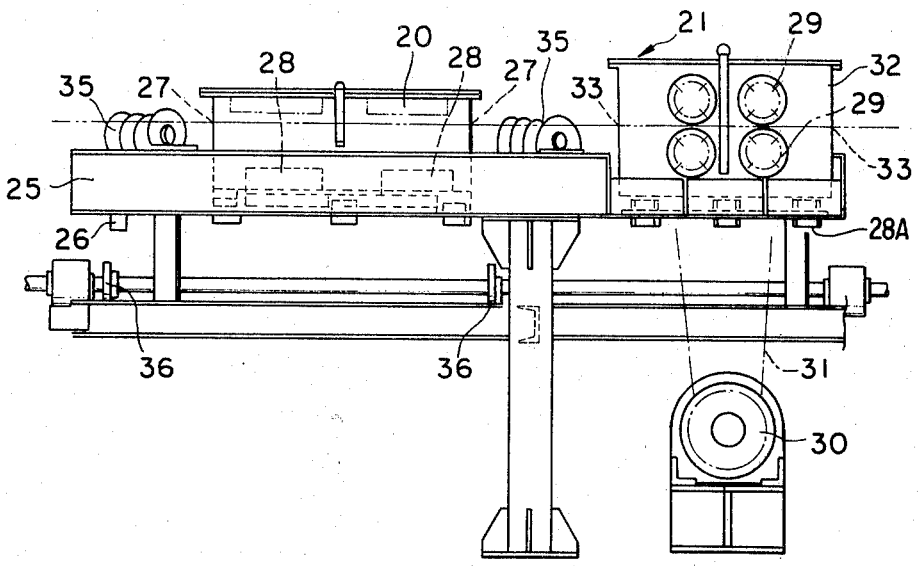
FIG. 5 is a front elevational view of the cleaning tank and cleaning brush unit shown in FIG. 4.
Figure 6:
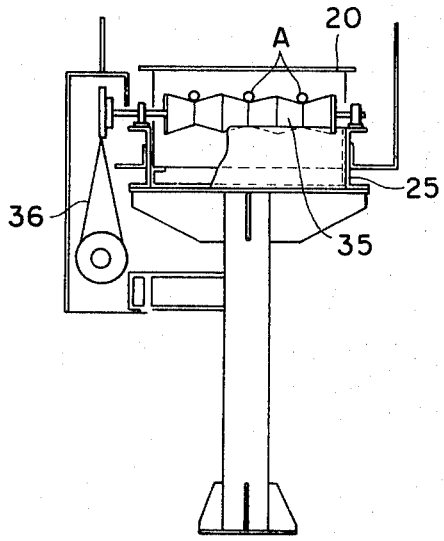
FIG. 6 is a partially cut-away side elevational view of the apparatus illustrated in FIG. 5.
Figure 7:
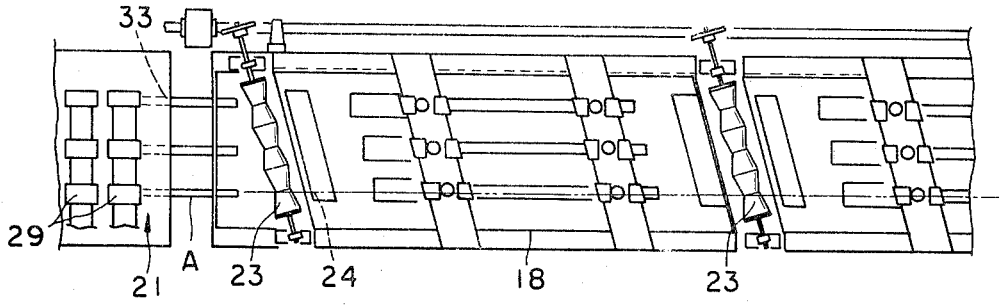
FIG. 7 is a plan view of an inlet side of the outer surface pickling apparatus.
Figure 8:
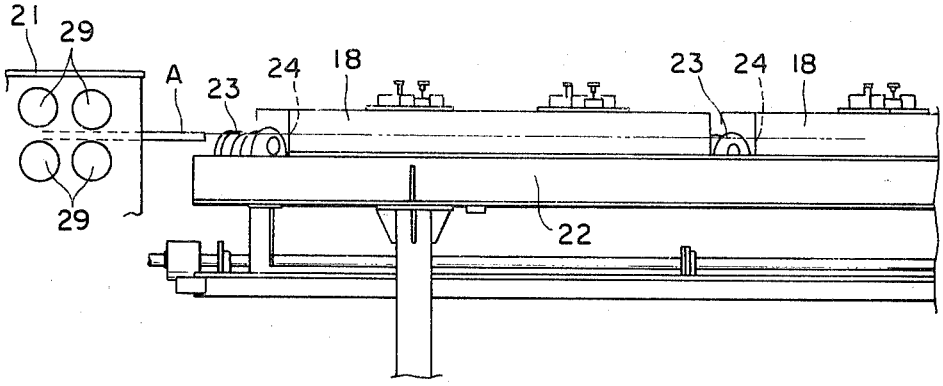
FIG. 8 is a front elevational view of the inlet side of the outer surface pickling apparatus of FIG. 8.
Figure 9:
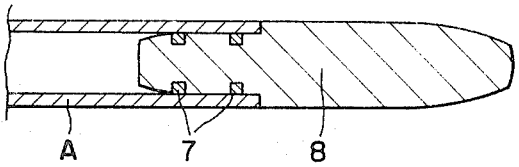
FIG. 9 is an enlarged cross-sectional view of an end portion of an embodiment of a plugged tubular material.

In the pretreatment step, a tubular member which has been subjected in advance to a degreasing treatment is conveyed onto a stock table 2 by means of a crane 3. The tubular member is then charged into a tube interior pickling apparatus 5 by conveyors 4 provided on the table 2. Plugs 8 are then inserted into both end portions of the thus-treated member with sealing members 7 interposed therebetween by a plugging machine 6 as shown in FIG. 9. Then, the thus-plugged tubular material is conveyed onto the charging-side conveyor device 9 of an outer surface pickling apparatus 1.

On the other hand, in the post-treatment step, the plugs 8 are pulled out from the tubular member by an unplugging machine 11 to which the tubular member has been conveyed by means of a discharge-side conveyor device 10. Then, the tubular member is dipped into a slightly warm water tank 13 through a chute 12 or the like and subjected to a rinsing treatment on endless wrapping connectors 14 provided in the tank 13. Then, the tubular member is treated sequentially in a high-temperature water tank 16, alkaline water tank 17 or the like, and finally conveyed to a drying chamber (not shown) through a purified water tank or the like (not shown).

In the outer surface pickling apparatus according to this invention, there are provided between the charging-side conveyor device 9 and discharge-side conveyor device 10 a plurality of liquid tanks separately containing pickling liquids of different types and defining through-holes 24 on common longitudinal lines, such as a plurality of tanks 18 containing a mixed acid of nitric acid and a hydrofluoric acid, neutralization tank 19 containing aluminum nitrate, etc. In the illustrated embodiment, the tubular members A are caused to pass in three rows through each of the liquid tanks and are pickled therein. Furthermore, a cleaning tank 20 containing a cleaning liquid and ultrasonic cleaning oscillators 28 as well as a cleaning brush unit 21 are also provided before the first liquid tank 18.

Referring now to FIG. 4 through FIG. 8, numeral 22 indicates a pickling table frame on which the above-described various tanks 18, 19 are mounted. Between each two liquid tanks 18, 19, there is provided a rotating and feeding member 23 which is illustrated in the form of a skew roller in the drawings, thereby making it possible to convey each of the hermetically plugged tubular members A through holes 24 on a common longitudinal line in a lengthwise direction of the tubular member while rotating the same tubular member around its longitudinal axis.

The cleaning tank 20 containing the cleaning liquid is mounted on a table frame 25 and provided with a drain opening 26 for discharging the cleaning liquid from the tank 20. Through-holes 27 are formed in the front and rear walls thereof on the longitudinal axes of tubular members A to be conveyed in three rows therethrough. The ultrasonic cleaning oscillators 28, which apply vibration to the cleaning liquid in the cleaning tank 20, are detachably provided on the bottom wall of the tank 20 respectively at a front and rear locations thereof.

Furthermore, the cleaning brush unit 21 is disposed at the discharge-side of the cleaning tank 20. Rotary brushes 29 are provided in pairs above and below the longitudinal axes of tubular members A to be conveyed therethrough. The brushes 29 are operably driven by a motor 30 through a wrapping connector 31.

The rotary brushes 29 are transversely supported in a casing 32 by bearings and caused to rotate about their respective axes. The casing 32 defines through-holes 33 in the front and rear walls thereof. Needless to say, the brushing unit 21 is adapted to brush off any cleaning liquid or the like still remaining on the circumferential outer surface of each of the tubular members A.

The conveyor member 34 of each of the above-described conveyor devices 9, 10 is a skew roller. Similar conveyor members 35 are provided respectively before and after the cleaning tank 20. These conveyor members 35 are driven by a wrapping connector 36 or the like shown in FIG. 5 and FIG. 6.

Similar to the prior art publication referred to in the preamble of this specification (namely, Japanese Patent Publication No. 39629/1980), a shower mechanism 50 may be provided between each two adjacent outer surface pickling tanks 18, 19 (not shown). Numeral 37 indicates a travelling car for the cranes 3, 15 while its rails are designated by numeral 38. Numerals 39, 40, 41 indicate each a tube feeder for the pretreatment step.

According to the above-described embodiment of this invention, the tubular member A which has previously been subjected to an inner surface pickling treatment is subjected to an outer surface pickling treatment during its passage in a hermetically plugged state through the outer surface pickling tanks 18, 19 which separately contain pickling liquids of different types. Cleaning tank 20 containing the cleaning liquid is also provided before the pickling tanks 18, 19. Ultrasonic cleaning oscillators 28 apply vibration to the cleaning liquid contained in the cleaning tank 20. Thus, while passing through the cleaning tank 20, any oil, grease, dust or the like adhered on the outer surface of the tubular member A can be thoroughly and surely separated and removed from the outer surface. Furthermore, by brushing off any cleaning liquid or the like by the cleaning brush unit 21 disposed after the cleaning tank 20, it is possible to remove any foreign substances which may adversely affect on the pickling treatment of the outer surface of the tubular member A, thereby making it possible to obtain a tubular member having a particularly outstanding surface quality.

Owing to the provision of the cleaning tank 20, which makes use of the ultrasonic cleaning oscillators 28, and the cleaning brush unit 21 before the tanks 18, 19 for pickling the outer surfaces of tubular members, any oil, grease, dust or the like can be completely removed from the outer surfaces of the tubular members. Since the cleaning liquid in the cleaning tank 20 is vibrated by means of the ultrasonic cleaning oscillators 28, separation of oil or grease is ensured, thus, in combination with the cleaning by the cleaning brush unit 21, allowing a pickling treatment to be performed while removing any foreign substance harmful to the quality of the surface of each tubular member and thereby providing a practically important advantage.

Having now fully described the invention, it will be apparent to one of ordinally skill in the art that many changes and modifications can be made thereto without departing from the spirit or scope of the invention as set forth herein.

What is claimed as new and desired to be secured by Letters Patent of the United States is:

1. An apparatus for continuously pickling the outer surface of hermetically plugged tubular members comprising:

a plurality of liquid containing tanks which separately contain different pickling liquids and define through-holes in respective front and rear walls thereof on at least one common longitudinal line to permit the successive passage of the tubular members therethrough;

means for successively feeding the tubular members through said through-holes and for rotating the tubular materials around their respective longitudinal axes;

a cleaning tank containing a cleaning liquid; and a cleaning brush unit positioned upstream of said plurality of tanks and downstream of said cleaning tank wherein said cleaning tank further comprises at least one ultrasonic cleaning oscillator disposed therein and defining sealed through-holes in the front and rear walls thereof for allowing said tubular members to pass through said cleaning tank and subsequently to said cleaning brush unit.

2. The apparatus as claimed in claim 1, wherein said means for successively feeding the tubular members further comprise a plurality of skew rolls operably disposed, respectively, before the cleaning tank, between the cleaning tank and cleaning unit, between the cleaning unit and a first liquid tank of said plurality of liquid tanks, and between two adjacent liquid tanks of said plurality of liquid tanks, for conveying said tubular members through the cleaning tank, said cleaning brush unit and said plurality of liquid tanks while rotating said tubular members.

3. The apparatus as claimed in claim 2, wherein said cleaning tank and said plurality of liquid tanks define a plurality of through-holes in each of front and rear walls thereof on a plurality of common longitudinal lines, and each of said skew rollers defines a plurality of circumferential grooves on said common longitudinal lines, for allowing simultaneous treatment of the tubular members in the cleaning tank, said cleaning brush unit and said plurality of liquid tanks without causing initial contact of each of said tubular members.

4. The apparatus as claimed in claim 1, 2 or 3, wherein said cleaning brush unit further comprises at least one pair of rotary brushes provided, respectively, above and below said at least one common longitudinal line.

5. The apparatus as claimed in claim 1, wherein said plurality of liquid containing tanks further comprises first and second adjacent liquid tanks and further comprising means disposed between said first and second adjacent liquid tanks for washing said tubular members upon being fed therebetween.

6. The apparatus as claimed in claim 1, 2 or 3, further comprising means for detachably mounting said ultrasonic cleaning oscillator on a bottom wall of the cleaning tank.

* * * * *